US005710117A

United States Patent [19]

David et al.

[11] Patent Number: 5,710,117

[45] Date of Patent: Jan. 20, 1998

[54] DETERGENT FORMULATION WITH ANTI SOILING PROPERTIES FOR WASHING LAUNDRY

[75] Inventors: Claire David, Paris; Etienne Fleury, Irigny, both of France

[73] Assignee: Rhone-Poulenc Chimie, Courbevoie, France

[21] Appl. No.: 627,517

[22] Filed: Apr. 4, 1996

[30] Foreign Application Priority Data

Apr. 5, 1995 [FR] France ..... 95 04015

[51] Int. Cl.[6] ..... C11D 3/37

[52] U.S. Cl. ..... 510/299; 8/137; 510/427; 510/528; 525/457; 525/458; 528/904

[58] Field of Search ..... 8/137; 510/299, 510/475, 528; 525/457, 458; 528/904

[56] References Cited

U.S. PATENT DOCUMENTS

| | | | |
|---|---|---|---|
| 4,201,824 | 5/1980 | Violland | 428/262 |
| 4,240,918 | 12/1980 | Lagasse et al. | 510/299 |
| 4,795,584 | 1/1989 | Ross et al. | 510/299 X |
| 5,597,795 | 1/1997 | Fredj et al. | 510/299 X |

FOREIGN PATENT DOCUMENTS

| | | |
|---|---|---|
| 0286019 | 10/1988 | European Pat. Off. . |
| 2308646 | 11/1976 | France . |
| 2334698 | 7/1977 | France . |
| 2407980 | 6/1979 | France . |

*Primary Examiner*—Michael Lusignan
*Attorney, Agent, or Firm*—John Daniel Wood

[57] ABSTRACT

Detergent formulation for washing laundry characterized in that it comprises:

from about 10 to 80% of its weight of at least one hydrated zeolite (z) of formula $$xNa_2O.yAl_2O_3.zSiO_2.wH_2O$$

in which, if y=1, x is from about 0.7 to 1.1, z is from about 1.3 to 3.3 and w is from about 10 to 264 from about 0.005 to 5%, of its weight of a least one polyalkylene terephthalate-polyoxyalkylenebisurethane (PET-UPOEU) copolymeric nonionic or anionic anti-soiling agent, said copolymer being obtained by reaction of a polyalkylene terephthalate (PET) and a polyoxyalkylnebisurethane (UPOEU), the molar ratio of the NCO functions to all of the OH functions or OH function equivalents being from about 0.5 to 1, from about 3 to 40%, of its weight of a least one saturated $C_5$–$C_{24}$, aliphatic or hydroxyaliphatic alkyl sulphate anionic surfactant (FAS) optionally condensed with approximately 0.5 to 30 mol of ethylene oxide and/or propylene oxide, optionally, up to 15% of its weight of a nonionic surfactant, it not being possible for more than 5% by weight of the said detergent formulation to consist of an alkylbenzenesulphonate.

It has been observed that this PET-UPOEU type of anti-soiling agent, present in low amount in detergent compositions based on zeolite and aliphatic alkyl sulphate, has advantageous anti-soiling properties.

26 Claims, No Drawings

DETERGENT FORMULATION WITH ANTI SOILING PROPERTIES FOR WASHING LAUNDRY

The present invention relates to a detergent formulation for washing laundry, containing a polyalkylene terephthalate-polyoxyalkylenebisurethane copolymer as anti-soiling agent.

It is known (U.S. Pat. No. 4,201,824, FR 2,407,980) to use, as anti-soiling agent in tripolyphosphate-based detergent compositions, polyester-polyurethanes, in particular polyalkylene terephthalate-polyoxyethylene-bisurethanes obtained by reaction of a polyester with a number-average molecular mass of 300–4,000, prepared from terephthalic acid and/or sulphoisophthalic acid and a diol with a mass of less than 300, with a prepolymer containing terminal isocyanate groups prepared from a polyoxyethylene glycol of molecular mass 600–4,000 and an isocyanate. This anti-soiling agent has been used, at a proportion of 3% by weight, in detergent compositions based on sodium tripolyphosphate and sodium alkylbenzene sulphonate.

The Applicant has now observed that this type of anti-soiling agent, present in low amount in detergent compositions based on zeolite and aliphatic alkyl sulphate, has advantageous anti-soiling properties.

The subject of the present invention is a detergent formulation for washing laundry, characterized in that it comprises:

from about 10 to 80%, preferably from about 15 to 50%, of its weight of at least one hydrated zeolite (Z) of formula $$xNa_2O.yAl_2O_3.zSiO_2.wH_2O$$

in which, if y=1, x is from about 0.7 to 1.1, z is from about 1.3 to 3.3 and w is from about 10 to 264 from about 0.005 to 5%, preferably from about 0.1 to 2%, of its weight of at least one polyalkylene terephthalate-polyoxyalkylenebisurethane (PET-UPOEU) copolymeric nonionic or anionic anti-soiling agent, this copolymer being obtained by reaction of a polyalkylene terephthalate (PET) and a polyoxyalkylene-bisurethane (UPOEU), the molar ratio of the NCO functions to all of the OH functions or OH function equivalents being from about 0.5 to 1, preferably from about 0.8 to 1, from about 3 to 40%, preferably from about 5 to 35%, of its weight of at least one anionic surfactant (FAS) chosen from saturated $C_5$–$C_{24}$, preferably $C_8$–$C_{18}$, aliphatic or hydroxyaliphatic alkyl sulphates optionally condensed with 0.5 to 30 mol approximately, preferably 0.5 to 10 mol, of ethylene oxide and/or propylene oxide, optionally, up to 15%, preferably from about 3 to 15%, of its weight of a nonionic surfactant (NI), it not being possible for more than 5% by weight of the said detergent formulation to consist of an anionic surfactant other than the alkyl sulphates (FAS), which have less advantageous ecotoxicological properties than $C_1$–$C_{18}$alkylbenzenesulphonates.

The hydrated zeolites (Z) which may be used as constituent (A) are preferably crystalline and contain from about 8 to 28% by weight of water, preferably from about 1.8 to 22% by weight of water. Finely divided zeolites having an average primary particle diameter of between 0.1 and 10 μm and advantageously of between 0.5 and 5 μm, as well as a theoretical cation exchange power of greater than 100 mg of $CaCO_3$/g of anhydrous product and preferably of greater than 200 mg, may be chosen in particular.

Zeolites of type A, P, X or Y, and in particular 4A and 13X, may be mentioned more particularly. By way of example, mention may be made of the zeolites forming the subject of French patent applications Nos. 2,225,568, 2,269,575, 2,283,220, 2,376,074, 2,384,716, 2,392,932 and 2,528,722, the teaching of which is incorporated in the present application. The last reference cited is based in particular on zeolites having a rate constant, relative to the surface of the zeolites per liter of solution, of greater than 0.15 $s^{-1}$ 1 $m^{-2}$, preferably of greater than 0.25 and advantageously of between 0.4 and 4 $s^{-1}$ 1 $m^{-2}$. These zeolites have particularly advantageous qualities in their use in detergency.

The nonionic or anionic anti-soiling agents (PET-UPOEU) which may be used have been described in particular in patent U.S. Pat. No. 4,201,824 and French patent FR 2,407,980.

These agents are linear hydrophilic copolymers resulting from the reaction of 10 to 70 parts by weight approximately of a base polyalkylene terephthalate (PET) whose acid number is less than or equal to 3 mg KOH/g and whose hydroxyl number is less than 120 mg KOH/g, and 90 to 30 parts by weight approximately of a prepolymer containing urethane groups (UPOEU), obtained by reaction of at least one polyalkylene glycol with at least one diisocyanate.

The base polyalkylene terephthalate (PET) may be obtained by esterification and/or transesterification and polycondensation of a base monomer composition:

of a non-sulphonated diacidic monomer (A) consisting of at least one dicarboxylic acid or anhydride chosen from terephthalic, isophthalic and 2,6-naphthalenedicarboxylic acid or anhydride, or the diesters thereof, it being possible for from 0 to 40 mol %, preferably from 0 to 15 mol %, of the amount of non-sulphonated diacidic monomer (A) to be replaced by a sulphonated diacidic monomer (SA) consisting of at least one sulphonated aromatic or sulphonated aliphatic dicarboxylic acid or anhydride, or the diesters thereof, and of a polyol monomer (P) consisting of at least one polyol chosen from ethylene glycol, propylene glycol, diethylene glycol, dipropylene glycol, higher homologues thereof having a molecular mass which may be up to about 300, glycerol, 1,2,4-butanetriol and 1,2,3-butanetriol, in an amount corresponding to a ratio of the number of OH functions of the polyol monomer (P) to the number of COOH functions or function equivalents of the diacidic monomers (A)+(SA) of about 1.05 to 4, preferably of about 1.1 to 3.5 and, most particularly, of about 1.8 to 3.

The elemental species considered in the definition of a mole of monomer (A) or (SA) is the COOH function in the case of the diacids or the COOH function equivalent in the case of the anhydrides or diesters.

The non-sulphonated diacidic monomer (A) preferably consists of 50 to 100 mol %, most particularly of 70 to 100 mol %, of terephthalic acid or anhydride or one of the lower diesters thereof (methyl, ethyl, propyl, isopropyl or butyl diester) and from 0 to 50 mol %, most particularly from 0 to 30 mol %, of isophthalic acid or anhydride and/or of 2,6-naphthalenedicarboxylic acid or anhydride and/or of adipic acid, or one of the lower diesters thereof (methyl, ethyl, propyl, isopropyl or butyl diester); the preferred diesters are the methyl diesters. Minor amounts of aromatic diacids other than those mentioned above, such as orthophthalic acid, anthracene, 1,8-naphthalene, 1,4-naphthalene and biphenyl dicarboxylic acids or aliphatic diacids such as glutaric acid, succinic acid, trimethyladipic acid, pimelic acid, azelaic acid, sebacic acid, suberic acid, itaconic acid, maleic acid, etc. in acid, anhydride or lower diester (methyl, ethyl, propyl, isopropyl or butyl diester) form, may also be present in the non-sulphonated diacidic monomer (A).

The possible sulphonated diacidic monomer (SA) has at least one sulphonic acid group, preferably in the form of a sulphonate of an alkali metal (preferably sodium), and two acid functions or acid function equivalents (that is to say an anhydride function or two ester functions) attached to one or more aromatic rings when these are aromatic dicarboxylic acids or anhydrides or the diesters thereof, or attached to the aliphatic chain when these are aliphatic dicarboxylic acids or anhydrides or the diesters thereof.

Among the sulphonated diacidic monomers (SA) which may be mentioned are aromatic sulphonated dicarboxylic acids or anhydrides such as sulpho-isophthalic, sulpho-terephthalic or sulpho-ortho-phthalic acids or anhydrides, 4-sulpho-2,7-naphthalenedicarboxylic acids or anhydrides, sulpho-4,4'-bis(hydroxycarbonyl)diphenylsulphones, sulpho-diphenyldicarboxylic acids or anhydrides, sulpho-4,4'-bis(hydroxycarbonyl)diphenylmethanes, sulpho-5-phenoxyisophthalic acids or anhydrides, or the lower diesters thereof (methyl, ethyl, propyl, isopropyl or butyl diesters), and sulphonated aliphatic sulphonated dicarboxylic acids or anhydrides such as sulphosuccinic acids or anhydrides or the lower diesters thereof (methyl, ethyl, propyl, isopropyl or butyl diesters). The preferred sulphonated diacidic monomers (SA) are sulphoisophthalic and sulphosuccinic acids or anhydrides and the methyl diesters thereof and, most particularly, dimethyl sodio-5-oxysulphonyliso-phthalate.

The polyol monomer (P) preferably used is monoethylene glycol and/or polyethylene glycols of molecular mass which may be up to 300.

The said polyalkylene terephthalates (PET) may be obtained by the usual processes of esterification and/or transesterification and polycondensation, for example by esterification and/or transesterification reaction, in the presence of an esterification/transesterification catalyst, of the polyol monomer (P) with the various diacidic monomers, each diacid being in acid or anhydride form or in the form of one of the diesters thereof, and polycondensation of the polyol esters at reduced pressure, in the presence of a polycondensation catalyst.

The prepolymer containing urethane groups (UPOEU) may be obtained by reaction of at least one polyalkylene glycol such as polyethylene glycols with a number-average molecular mass of about 300 to 6,000, preferably of about 600 to 4,000 and at least one aromatic, aliphatic or cycloaliphatic diisocyanate, in proportions such that the molar ratio of the NCO functions to all of the OH functions or OH function equivalents used in the synthesis of the copolymer (PET-UPOEU) is from about 0.5 to 1, preferably from about 0.8 to 1.

Among the diisocyanates which may be mentioned are toluylene diisocyanate, hexamethylene diisocyanate, isophorone diisocyanate, di(isocyanatophenyl)methane and di(isocyanatocyclohexyl)methane; 1,6-hexamethylene diisocyanate and 2,4- or 2,6-toluene diisocyanate may be mentioned most particularly.

The said nonionic or anionic anti-soiling agent (PET-UPOEU) may be obtained by addition of the prepolymer (UPOEU) to the molten polyalkylene terephthalate (PET) and maintenance at a temperature of about 100° to 280° C., preferably of about 150° to 200° C., until the viscosity of the medium becomes stationary.

Among the optionally alkoxylated alkyl sulphates (FAS) which may be used, mention may be made of non-ethoxylated $C_8C_{18}$ (preferably $C_{10}$–$C_{15}$) alkyl sulphates, $C_5$–$C_{13}$ (preferably $C_{10}$–$C_{13}$) fatty alkyl sulphates condensed with 1 to 30 mol approximately (preferably 1 to 10 mol) of ethylene oxide, $C_{14}$–$C_{20}$ (preferably $C_{14}$–$C_{18}$) fatty alkyl sulphates condensed with 4 to 30 mol approximately (preferably 4 to 10 mol) of ethylene oxide, the cation being an alkali metal (sodium, potassium or lithium), a substituted or unsubstituted ammonium residue (methyl-, dimethyl-, trimethyl- or tetramethylammonium, dimethylpiperidinium, etc.) or an alkanolamine derivative (monoethanolamine, diethanolamine, triethanolamine, etc.).

Among the nonionic surfactants (NI) which may optionally be present, mention may be made of glucosamide, glucamide and glycerolamide, polyoxyalkylenated $C_8$–$C_{22}$ aliphatic alcohols containing from 1 to 25 oxyalkylene units (oxyethylene or oxypropylene); by way of example, mention may be made of Tergitol 15-S-9, Tergitol 24-L-6 NMW marketed by Union Carbide Corp., Neodol 45-9, Neodol 23-65, Neodol 45-7 or Neodol 45-4 marketed by Shell Chemical Cy., Kyro EOB marketed by The Procter & Gamble Co., and Symperonic marketed by ICI;

products resulting from the condensation of ethylene oxide the compound resulting from the condensation of propylene oxide with propylene glycol, such as Pluronic marketed by BASF;

products resulting from the condensation of ethylene oxide the compound resulting from the condensation of propylene oxide with ethylenediamine, such as Tetronic marketed by BASF;

amine oxides such as dimethylamine $C_{10}$–$C_{18}$ alkyl oxides and $C_8$–$C_{22}$ alkoxyethyldihydroxyethylamine oxides;

the alkylpolyglycosides described in U.S. Pat. No. 4,565,647;

$C_8$–$C_{20}$ fatty acid amides
ethoxylated fatty acids
ethoxylated fatty amides
ethoxylated amines Minor amounts of polyoxyalkylenated (polyethoxyethylenated, polyoxypropylenated or polyoxybutylenated) alkylphenols whose alkyl substituent is $C_6$–$C_{12}$ and which contain from 5 to 25 oxyalkylene units may also be present; examples which may be mentioned are Triton X-45, X-114, X-100 or X-102 marketed by Rohm & Haas Co.

Besides the constituents (Z), (PET-UPOEU), (FAS) and (NI) mentioned above, other additives of the type described below may also be present in the said detergent formulation.

SURFACTANTS, in amounts corresponding to approximately 3–40% by weight, relative to the detergent composition, surfactants such as anionic surfactants alkyl ester sulphonates of formula R—CH($SO_3$M)—COOR', where R represents a $C_{8-20}$, preferably $C_{10}$–$C_{16}$, alkyl radical, R' represents a $C_1$–$C_6$, preferably $C_1$–$C_3$, alkyl radical and M represents an alkali metal (sodium, potassium or lithium) cation, substituted or unsubstituted ammonium (methyl-, dimethyl-, trimethyl- or tetramethylammonium, dimethylpiperidinium, etc.) cation or an alkanolamine derivative (monoethanolamine, diethanolamine, triethanolamine, etc.) cation. Methyl ester sulphonates in which the radical R is $C_{14}$–$C_{16}$ may be mentioned most particularly;

alkylamide sulphates of formula RCONHR'$OSO_3$M where R represents a $C_2$–$C_{22}$, preferably $C_6$–$C_{20}$, alkyl radical, R' represents a $C_2$–$C_3$ alkyl radical, M represents a hydrogen atom or a cation of the same definition as above, and the ethoxylenated (EO) and/or propoxylenated (PO)

derivatives thereof, having on average from 0.5 to 60 EO and/or PO units;

saturated or unsaturated $C_8$–$C_{24}$, preferably $C_{14}$–$C_{20}$, fatty acid salts, $C_9$–$9_{20}$ alkylbenzenesulphonates, primary or secondary $C_8$–$C_{22}$ alkyl sulphonates, alkylglyceryl sulphonates, the sulphonated polycarboxylic acids described in GB-A-1,082,179, paraffin sulphonates, N-acyl N-alkyltaurates, alkyl phosphates, isethionates, alkyl succinamates, alkyl sulphosuccinates, sulphosuccinate monoesters or diesters, N-acyl sarcosinates, alkylglycoside sulphates and polyethoxycarboxylates the cation being an alkali metal (sodium, potassium or lithium), a substituted or unsubstituted ammonium residue (methyl-, dimethyl-, trimethyl-or tetramethylammonium, dimethylpiperidinium, etc.) or an alkanolamine derivative (monoethanolamine, diethanolamine, triethanolamine, etc.);

cationic surfactants alkyldimethylammonium halides amphoteric and zwitterionic surfactants alkyldimethylbetaines, alkylamidopropyldimethylbetaines, alkyltrimethylsulphobetaines and the products of condensation of fatty acids with protein hydrolysates.

alkylamphoacetates or alkylamphodiacetates in which the alkyl group contains from 6 to 20 carbon atoms.

OTHER ADJUVANTS WHICH IMPROVE THE PROPERTIES OF THE SURFACTANTS (other "builders"), in amounts corresponding to 5–50% approximately, preferably to 5–30% approximately, by weight for the liquid detergent formulae, or to 10–80% approximately, preferably 15–50%, by weight for the detergent formulae as powders, builders such as inorganic adjuvants ("builders")

alkali metal, ammonium or alkanolamine polyphosphates (tripolyphosphates, pyrophosphates, orthophosphates or hexametaphosphates)

tetraborates or borate precursors silicates, in particular those having an $SiO_2/Na_2O$ ratio from about 1.6/1 to 3.2/1 and the lamellar silicates described in U.S. Pat. No. 4,664,839 alkali metal or alkaline-earth metal carbonates (bicarbonates, sesquicarbonates)

the cogranulates of hydrated silicates of alkali metals and of alkali metal (sodium or potassium) carbonates rich in silicon atoms, in Q2 or Q3 form, described in EP-A-488,868 organic adjuvants ("builders")

water-soluble polyphosphonates (ethane-1-hydroxy-1,1-diphosphonates, methylenediphosphonate salts, etc.)

water-soluble salts of carboxylic polymers or copolymers or the water-soluble salts thereof, such as polyether carboxylates (oxydisuccinic acid and the salts thereof, monosuccinic acid tartrate and the salts thereof, disuccinic acid tartrate and the salts thereof)

hydroxypolyether carboxylates citric acid and the salts thereof, mellitic acid, succinic acid and the salts thereof salts of polyacetic acids (ethylenediamine-tetraacetates, nitrilotriacetates, N-(2-hydroxyethyl)-nitrilodiacetates)

$C_5$–$C_{20}$ alkylsuccinic acids and the salts thereof (2-dodecenylsuccinates, lauryl succinates)

polycarboxylic ester acetals polyaspartic acid, polyglutamic acid and the salts thereof polyimides derived from the polycondensation of aspartic acid and/or glutamic acid polycarboxymethylated derivatives of glutamic acid or of other amino acids BLEACHING AGENTS, in amounts of about 0.1–20%, preferably of about 1–10%, by weight, optionally combined with BLEACHING ACTIVATORS, in amounts of about 0.1–60%, preferably of about 0.5–40%, by weight, agents and activators such as bleaching agents perborates such as sodium perborate monohydrate or tetrahydrate peroxygenated compounds such as sodium carbonate peroxyhydrate, pyrophosphate peroxyhydrate, urea peroxyhydrate, sodium peroxide or sodium persulphate preferably combined with a bleaching activator which generates in situ, in the washing medium, a carboxylic peroxy acid; among these activators, mention may be made of tetraacetylethylenediamine, tetraacetylmethylenediamine, tetraacetyl glycoluryl, sodium p-acetoxybenzene sulphonate, pentaacetyl glucose, octaacetyl lactose, etc.

percarboxylic acids and the salts thereof (referred to as "percarbonates") such as magnesium monoperoxyphthalate tetrahydrate, magnesium meta-chloroperbenzoate, 4-nonylamino-4-oxoperoxybutyric acid, 6-nonylamino-6-oxoperoxycaproic acid, diperoxydodecanedioic acid, peroxysuccinic acid nonylamide and decyldiperoxysuccinic acid. These agents may be combined with at least one of the anti-soiling agents or anti-redeposition agents mentioned below.

Non-oxygenated bleaching agents acting by photoactivation in the presence of oxygen, these agents being such as sulphonated aluminium and/or zinc phthalocyanins, may also be mentioned other ANTI-SOILING AGENTS, in amounts of about 0.01–10%, preferably of about 0.1–5% and, most particularly, of about 0.2–3%, by weight, these agents being such as cellulose derivatives such as cellulose hydroxy ethers, methylcellulose, ethylcellulose, hydroxypropyl methylcellulose and hydroxybutyl methylcellulose polyvinyl esters grafted onto polyalkylene trunks, such as polyvinyl acetates grafted onto polyoxyethylene trunks (EP-A-219,048)

polyvinyl alcohols polyester copolymers based on ethylene terephthalate and/or propylene terephthalate and polyoxyethylene terephthalate mits, with an ethylene terephthalate and/or propylene terephthalate (number of units)/polyoxyethylene terephthalate (number of units) molar ratio from about 1/10 to 10/1, preferably from about 1/1 to 9/1, the polyoxyethylene terephthalates having polyoxyethylene mits with a molecular weight of about 300 to 5,000, preferably of about 600 to 5,000 (U.S. Pat. No. 3,959,230, U.S. Pat. No. 3,893,929, U.S. Pat. No. 4,116,896, U.S. Pat. No. 4,702,857 and U.S. Pat. No. 4,770,666);

sulphonated polyester oligomers obtained by sulphonation of an oligomer derived from ethoxylated allyl alcohol, dimethyl terephthalate and 1,2-propylene diol, having from 1 to 4 sulphonated groups (U.S. Pat. No. 4,968,451)

polyester copolymers based on propylene terephthalate and polyoxyethylene terephthalate units and ending with ethyl or methyl units (U.S. Pat. No. 4,711,730) or polyester oligomers ending with alkyl polyethoxy groups (U.S. Pat. No. 4,702,857) or sulphopolyethoxy anionic groups (U.S. Pat. No. 4,721,580) or sulphoaroyl anionic groups (U.S. Pat. No. 4,877,896)

ANTI-REDEPOSITION AGENTS, in amounts of about 0.01–10% by weight for a detergent composition as a powder, of about 0.01–5% by weight for a liquid detergent composition, agents such as ethoxylated monoamines or polyamines, ethoxylated amine polymers (U.S. Pat. No. 4,597,898, EP-A-11,984)

carboxymethylcellulose sulphonated polyester oligomers obtained by condensation of isophthalic acid, dimethyl sulphosuccinate and diethylene glycol (FR-A-2,236,926)

polyvinylpyrrolidones iron and magnesium CHELATING AGENTS, in amounts of about 0.1–10%, preferably of about 0.1–3%, by weight, agents such as aminocarboxylates such as ethylenediaminetetraacetates, hydroxyethyl ethylenediaminetriacetates and nitrilotriacetates aminophosphonates such as nitrilotris (methylenephosphonates)

polyfunctional aromatic compounds such as dihydroxydisulphobenzenes

POLYMERIC DISPERSING AGENTS, in an amount of about 0.1–7% by weight, in order to control the hardness with respect to calcium and magnesium, agents such as water-soluble salts of polycarboxylic acids with a molecular mass of about 2,000 to 100,000, obtained by polymerization or copolymerization of ethylenically unsaturated carboxylic acids such as acrylic acid, maleic acid or anhydride, fumaric acid, iraconic acid, aconitic acid, mesaconic acid, citraconic acid and methylenemalonic acid and, most particularly, the polyacrylates with a molecular mass of about 2,000 to 10,000 (U.S. Pat. No. 3,308,067) and the copolymers of acrylic acid and maleic anhydride with a molecular mass of about 5,000 to 75,000 (EP-A-66,915)

polyethylene glycols with a molecular mass of about 1,000 to 50,000

FLUORESCENCE AGENTS (BRIGHTENERS), in an amount of about 0.05–1.2% by weight, agents such as stilbene, pyrazoline, coumarin, fumaric acid, cinnamic acid, azole, methinecyanin, thiophene, etc. derivatives ("The production and application of fluorescent brightening agents"—M. Zahradnik, published by John Wiley & Sons, New York-1982)

FOAM SUPPRESSANTS, in amounts which may be up to 5% by weight, agents such as $C_{10}$–$C_{24}$ monocarboxylic fatty acids or the alkali metal, ammonium or alkanolamine salts thereof, and fatty acid triglycerides aliphatic, alicyclic, aromatic or heterocyclic saturated or unsaturated hydrocarbons, such as paraffins or waxes N-alkylaminotriazines monostearyl phosphates and monostearyl alkyl phosphates polyorganosiloxane oils or resins optionally combined with silica particles SOFTENERS, in amounts of about 0.5–10% by weight, agents such as clays ENZYMES in an amount which may be up to 5 mg by weight, preferably of about 0.05–3 mg, of active enzyme/g of detergent composition, enzymes such as proteases, amylases, lipases, cellulases or peroxidases (U.S. Pat. No. 3,553,139, U.S. Pat. No. 4,101,457, U.S. Pat. No. 4,507,219 and U.S. Pat. No. 4,261,868)

OTHER ADDITIVES such as alcohols (methanol, ethanol, propanol, isopropanol, propanediol, ethylene glycol or glycerol)

buffers fragrances pigments

The examples which follow are given by way of illustration.

EXAMPLE 1

The anti-soiling agent (PET-UPOEU) used is the polyethylene terephthalatepolyoxy-ethylenebisurethane prepared in Example 6 of U.S. Pat. No. 4,201,824.

This agent has:

a weight-average molecular mass of 62,000 a number-average molecular mass of 27,000, determined by gel permeation chromatography in dimethylacetamide containing $10^{-2}$N of LiBr, at 25° C., the results being expressed as polystyrene equivalents.

The anti-soiling properties of the following washing composition are tested:

| Composition of the washing product | parts by weight |
|---|---|
| zeolite 4A | 25 |
| light carbonate | 15 |
| disilicate R2A | 5 |
| Sokalan CP5 acrylic/maleic copolymer (BASF) | 5 |
| Na sulphate | 10.4 |
| carboxymethylcellulose | 1 |
| perborate monohydrate | 15 |
| tetraacetylethylenediamine | 5 |
| sodium lauryl sulphate | 6 |
| Symperonic A3 ($C_{12}$—$C_{15}$ fatty alcohol ethoxylated with 3 EO) | 3 |
| Symperonic A9 ($C_{12}$—$C_{15}$ fatty alcohol ethoxylated with 9 EO) | 9 |
| Esperase 4.0 T enzyme | 0.3 |
| copolymer (PET-UPOEU) | 0.3 |

ANTI-SOILING PROPERTIES

Test

Prewash:

Eight squares, 4 made of polyester and 4 made of polyester/cotton (65/35) 10×10 cm in size are prewashed in a Tergotometer for 20 minutes at 40° C., with the washing formula containing 0.3% by weight of active material of anti-soiling agent; the water used has a hardness of 30° HT; the amount of washing product used is 5 g per 1 liter of water.

The squares of fabric are then rinsed 3 times for 5 minutes with cold water (14° C.) and then dried by passing twice through pressing rollers.

Staining:

4 drops of engine sump oil are placed on the 8 prewashed squares and, in order to ensure good fixing of the stain, the fabrics are placed in an oven at 60° C. for 1 hour. To allow for good reproducibility of the results, the fabrics are washed within 24 hours.

Washing:

The washing is carried out under the same conditions as for the prewash (at 40° C. for 20 minutes, using 5 g of washing product containing 0.3% of active material of anti-soiling polymer per 1 liter of 30° HT water, followed by 3 5-minute rinses with cold water and drying twice in pressing rollers).

Evaluation

The reflectance of the fabrics before and after washing is measured using a DR.LANGE/LUCI 100 colorimeter.

The effectiveness of the test polymer as an anti-soiling agent is assessed by the % of removal of the stains calculated by the formula $$E \text{ in } \% = 100 \times (R3 - R2)/(R1 - R2)$$

R1 representing the reflectance before washing of the unsoiled fabric

R2 representing the reflectance, before washing, of the soiled fabric

R3 representing the reflectance, after washing, of the soiled fabric

The average of the % of removal of the stains is calculated.

This is 55%, compared with 10% in the absence of anti-soiling agent.

EXAMPLE 2

The test described above is repeated, replacing, in the overall washing product formula, the sodium lauryl sulphate by a sodium sulphate of a mixture of $C_{12}$–$C_{14}$ fatty alcohols (Sulfopon TA 85® from Sinnova).

The average of the % of removal of the stains E is 52%.

What is claimed is:

1. Detergent formulation for washing laundry which comprises:

from about 10 to 80% of its weight of at least one hydrated zeolite (z) of formula $$xNa_2O.yAl_2O_3.zSiO_2.wH_2O$$

in which, if y=1, x is from about 0.7 to 1.1, z is from about 1.3 to 3.3 and w is from about 10 to 264 from about 0.005 to 5%, of its weight of a least one polyalkylene terephthalate-polyoxyalkylenebisurethane (PET-UPOEU) copolymeric nonionic or anionic anti-soiling agent, said copolymer being obtained by reaction of a polyalkylene terephthalate (PET) and a polyoxyalkylne-bisurethane (UPOEU), the molar ratio of the NCO functions to all of the OH functions or OH function equivalents being from about 0.5 to 1 from about 3 to 40%, of its weight of a least one saturated $C_5$–$C_{24}$, aliphatic or hydroxyaliphatic alkyl sulphate anionic surfactant (FAS) optionally condensed with approximately 0.5 to 30 mol of ethylene oxide and/or propylene oxide, and optionally, up to 15% of its weight of a nonionic surfactant (NI), with the proviso that not more than 5% by weight of the said detergent formulation to consist of an anionic surfactant other than the alkyl sulphates (FAS).

2. Detergent formulation according to claim 1 wherein the quantity of hydrated zeolite ranges from about 15 to 50%.

3. Detergent formulation according to claim 1 wherein the quantity of polyalkylene terephthalate-polyoxyalkylenebisurethane ranges from about 0.1 to 2%.

4. Detergent formulation according to claim 1 wherein the molar ratio of the NCO functions to all of the OH functions or OH function equivalents is from about 0.8 to 1.

5. Detergent formulation according to claim 1 wherein the quantity of alkyl sulphate anionic surfactants (FAS) ranges from about 5 to 35%.

6. Detergent formulation according to claim 1 wherein the alkyl sulfate anionic surfactants (FAS) is a $C_8$–$C_{18}$ aliphatic or hydroxyaliphatic alkyl sulphate.

7. Detergent formulation according to claim 1 wherein the alkyl sulphate anionic surfactant (FAS) is condensed with 0.5 to 10 mol of ethylene oxide and/or propylene oxide.

8. Detergent formulation according to claim 1 wherein the nonionic surfactant (NI) ranges from about 3 to 15%.

9. Detergent formulation according to claim 1 wherein the base polyalkylene terephthalate (PET) is obtained by esterification and/or transesterification and polycondensation of a base monomer composition of:

a non sulphonated diacidic monomer (A) comprising at least one dicarboxylic acid or anhydride selected from the group consisting of isophthalic and 2,6-naphthalenedicarboxylic acid or anhydride, or the diesters thereof, wherein from 0 to 40 mol % of the amount of non-sulphonated diacidic monomer being replaceable by at least one sulphonated diacidic monomer (SA) selected from the group consisting of at least one sulphonated aromatic or sulphonated aliphatic dicarboxylic acid or anhydride, or the diesters thereof, and a polyol monomer (P) comprising of at least one polyol selected from the group consisting of ethylene glycol, propylene glycol, diethylene glycol, dipropylene glycol, higher homologues thereof having a molecular mass up to about 300, glycerol, 1,2,4-butanetrio and 1,2,3-butanetriol, in an amount corresponding to a ratio of the dumber of OH functions of the polyol monomer (P) to the number of COOH functions or function equivalents of the diacidic monomers (A)+(SA) of about 1.05 to 4.

10. Detergent formulation according to claim 9 wherein the amount of the non-sulphonated monomer ranges from 0 to 15 mol %.

11. Detergent formulation according to claim 9 wherein the ratio of the number of OH functions of the polyol monomer (P) to the number of COOH functions or function equivalents of the diacidic monomers (A)+(SA) is from about 1.1 to 3.05.

12. Detergent formulation according to claim 9 wherein said sulphonated diacidic monomer (SA) is a sulphoisophthaiic or sulphosuccinic acid or anhydride and the methyl diesters thereof.

13. Detergent formulation according to claim 12 wherein the sulphonated monomer is dimethyl sodio-5 oxysulphonylisophthalate.

14. Detergent formulation according to claim 1 wherein said polyoxyalkylenebisurethane (UPOEU)is obtained by reaction of at least one polyethylene glycol with a number-average molecular mass of about 300 to 6,000, and at least one aromatic, aliphatic or cycloaliphatic diisocyanate, in proportions such that the molar ratio of the NCO functions to all of the OH functions or OH function equivalents used in the synthesis of the copolymer (PET-UPOEU) is from about 0.5 to 1.

15. Detergent formulation according to claim 14 wherein the number average molecular mass is of about 600 to 4,000.

16. Detergent formulation according to claim 14 wherein the molar ratio of the NCO functions to all of the OH functions or OH function equivalents is from about 0.8 to 1.

17. Detergent formulation according to claim 1 wherein the diisocyanate is hexamethylene 1,6,-diisocyanate toluene or 2,4- or 2,6- diisocyanate.

18. Detergent formulation according to claim 1 wherein the optionally alkoxylated alkyl sulphate (FAS) selected from the group consisting of non-ethoxylated $C_8$–$C_{18}$alkyl sulphates, $C_5$–$C_{13}$ fatty alkyl sulphates condensed with approximately 1 to 30 mol of ethylene oxide, $C_{14}$–$C_{20}$ fatty alkyl sulphates condensed with approximately 4 to 30 mol of ethylene oxide, the cation being an alkali metal, a substituted or unsubstituted ammonium residue or an alkanolamine derivative.

19. Detergent formulation according to claim 18 wherein the alkyl sulphate is a non ethoxylated $C_{10}$–$C_{15}$alkyl sulphate.

20. Detergent formulation according to claim 18 wherein the $C_5$–$C_{13}$ fatty alkyl sulphate is a $C_{10}$–$C_{13}$alkyl sulphate.

21. Detergent formulation according to claim 18 wherein the $C_5$–$C_{13}$ fatty alkyl sulphate is condensed with approximately 1 to 10 mol of ethylene oxide.

22. Detergent formulation according to claim 18 wherein the $C_{14}$–$C_{20}$ fatty alkyl sulphate is a $C_{14}$–$C_{18}$ fatty alkyl sulphate.

23. Detergent formulation according to claim 18 wherein the $C_{14}$–$C_{20}$ fatty alkyl sulphate is condensed with approximately 4 to 10 mol of ethylene oxide.

24. Detergent formulation according to claim 18 wherein the substituted or unsubstituted ammonium residue is selected from the group consisting of methyl-, dimethyl-, trimethyl-, or ammonium, tetramethylammonium, and dimethylphiperidinium.

25. Detergent formulation according to claim 18 wherein the alkanolamine derivative is selected from the group consisting of monoethanolamine, diethanolamine, and triethanolamine.

26. Detergent formulation according to claim 1, wherein not more than 5% of its weight comprises a $C_1$–$C_{18}$alkylbenzenesulphonate.

* * * * *